US007784993B2

(12) United States Patent
Yu

(10) Patent No.: US 7,784,993 B2
(45) Date of Patent: Aug. 31, 2010

(54) WATERTIGHT LED LAMP

(75) Inventor: Jing Jing Yu, El Monte, CA (US)

(73) Assignee: 1 Energy Solutions, Inc., El Monte, CA (US)

( * ) Notice: Subject to any disclaimer, the term of this patent is extended or adjusted under 35 U.S.C. 154(b) by 230 days.

(21) Appl. No.: 12/172,228

(22) Filed: Jul. 12, 2008

(65) Prior Publication Data

US 2009/0021951 A1 Jan. 22, 2009

Related U.S. Application Data

(60) Provisional application No. 60/949,804, filed on Jul. 13, 2007.

(51) Int. Cl.
*F21V 33/00* (2006.01)
*H01R 33/965* (2006.01)

(52) U.S. Cl. ..... 362/657; 362/652; 439/699.2; 439/356

(58) Field of Classification Search ..... 362/267, 362/647, 652–657; 439/356, 619, 654, 699.2
See application file for complete search history.

(56) References Cited

U.S. PATENT DOCUMENTS

| | | | |
|---|---|---|---|
| 1,694,997 | A | 12/1928 | VanHorn |
| 3,519,913 | A | 7/1970 | Janecek |
| 3,593,038 | A | 7/1971 | Hylten-Cavallius |
| 3,639,822 | A | 2/1972 | Brown |
| 3,758,771 | A | 9/1973 | Frohardt |
| 4,035,681 | A | 7/1977 | Savage |
| 4,074,165 | A | 2/1978 | Moriyama |
| 4,223,248 | A | 9/1980 | Tong |
| 4,298,869 | A | 11/1981 | Okuno |
| 4,316,125 | A | 2/1982 | Noguchi |
| 4,321,598 | A | 3/1982 | Warner |
| 4,329,625 | A | 5/1982 | Nishizawa |
| 4,348,663 | A | 9/1982 | Yanagishima |
| 4,365,244 | A | 12/1982 | Gillessen |
| 4,367,471 | A | 1/1983 | Gillessen |
| 4,396,823 | A | 8/1983 | Nihei |
| 4,492,952 | A | 1/1985 | Miller |

(Continued)

FOREIGN PATENT DOCUMENTS

| | | |
|---|---|---|
| CA | 2342321 | 3/2000 |

OTHER PUBLICATIONS

Non-final Office Action mailed Feb. 7, 2006 in U.S. Appl. No. 10/984,651, filed Nov. 10, 2004 by Jing Jing Yu.

(Continued)

*Primary Examiner*—Thomas M Sember
(74) *Attorney, Agent, or Firm*—William W. Cochran; Cochran Freund & Young LLC

(57) ABSTRACT

Disclosed is a three-piece light emitting diode lamp. The lamp comprises a lamp holder that encapsulates and seals various connectors and connections. A removable light emitting diode is inserted into contact sockets so that the light emitting diode can be easily replaced. Various techniques are used to provide proper polarity for placement of the light emitting diode in the contact sockets. A lens cover is engaged in a ring cavity between an inner annular wall and an outer annular wall that seal and hold the lens cover to the lamp holder and provide a watertight seal.

11 Claims, 18 Drawing Sheets

U.S. PATENT DOCUMENTS 4,521,835 A 6/1985 Meggs
4,528,619 A 7/1985 Dolan
4,595,920 A 6/1986 Runyan
4,652,981 A 3/1987 Glynn
4,675,575 A 6/1987 Smith
4,727,603 A 3/1988 Howard
4,807,098 A 2/1989 Ahroni
4,839,777 A 6/1989 Janko
4,843,280 A 6/1989 Lumbard
4,857,920 A 8/1989 Kataoka
4,954,822 A 9/1990 Borenstein
4,959,766 A 9/1990 Jain
4,967,330 A 10/1990 Bell et al.
5,087,212 A 2/1992 Hanami
5,130,897 A 7/1992 Kuzma
5,155,669 A 10/1992 Yamuro
5,187,377 A 2/1993 Katoh
5,193,895 A 3/1993 Naruke
5,239,872 A 8/1993 Meyer-Bisch
5,257,020 A 10/1993 Morse
5,313,187 A 5/1994 Choi
5,321,593 A 6/1994 Moates
5,323,305 A 6/1994 Ikeda
5,366,780 A 11/1994 Rapisarda
5,368,503 A * 11/1994 Savage, Jr. ..... 439/502
5,404,282 A 4/1995 Klinke
5,410,458 A 4/1995 Bell
5,436,809 A 7/1995 Brassier
5,457,450 A 10/1995 Deese
5,463,280 A 10/1995 Johnson
5,481,444 A 1/1996 Schultz
5,499,174 A 3/1996 Lin
5,528,484 A 6/1996 Hayashi
5,567,037 A 10/1996 Ferber
5,580,159 A 12/1996 Liu
5,588,863 A * 12/1996 Wu ..... 439/356
5,647,759 A 7/1997 Lien
5,649,755 A 7/1997 Rapisarda
5,655,830 A 8/1997 Ruskouski
5,660,560 A 8/1997 Chong
5,663,719 A 9/1997 Deese
5,670,847 A 9/1997 Lin
5,672,000 A 9/1997 Lin
5,681,107 A 10/1997 Wang
5,720,544 A 2/1998 Shu
5,722,860 A 3/1998 Pan
5,726,535 A 3/1998 Yan
5,762,419 A 6/1998 Yan
5,808,592 A 9/1998 Mizutani
5,887,967 A 3/1999 Chang
5,890,794 A 4/1999 Abtahi
5,936,599 A 8/1999 Raymond
5,941,626 A 8/1999 Yamuro
5,962,971 A 10/1999 Chen
5,988,831 A 11/1999 Pan
6,048,074 A 4/2000 Wang
6,072,280 A 6/2000 Allen
6,079,848 A 6/2000 Ahroni
6,120,312 A 9/2000 Shu
6,183,104 B1 2/2001 Ferrara
6,183,310 B1 2/2001 Shu
6,190,021 B1 2/2001 Huang
6,200,003 B1 3/2001 Tseng
6,227,679 B1 5/2001 Zhang
6,283,797 B1 9/2001 Wu
6,361,198 B1 3/2002 Reed
6,367,952 B1 4/2002 Gibboney
6,461,019 B1 10/2002 Allen
6,478,455 B2 11/2002 Ahroni
6,505,954 B2 1/2003 Chen
6,550,953 B1 4/2003 Ichikawa et al.
D474,848 S 5/2003 Lodhie
D474,849 S 5/2003 Lodhie
6,598,996 B1 7/2003 Lodhie
D485,379 S 1/2004 Steklenburg
6,709,132 B2 3/2004 Ishibashi
6,717,526 B2 4/2004 Martineau
6,739,733 B1 5/2004 Lamke et al.
6,758,578 B1 7/2004 Chou
6,830,358 B2 12/2004 Allen
7,012,379 B1 3/2006 Chambers et al.
7,014,352 B2 3/2006 Wu
7,045,965 B2 5/2006 Li et al.
7,063,442 B2 6/2006 Sugar
7,066,628 B2 6/2006 Allen
7,066,636 B2 6/2006 Wu
7,118,249 B2 10/2006 Hsu et al.
7,217,005 B2 5/2007 Lin
7,220,022 B2 5/2007 Allen et al.
2002/0043943 A1 4/2002 Menzer et al.
2002/0105438 A1 8/2002 Forbes
2003/0025120 A1 2/2003 Chang
2003/0079387 A1 5/2003 Derose
2003/0147245 A1 8/2003 Chen
2003/0198048 A1 10/2003 Frederick
2004/0135522 A1 7/2004 Berman
2004/0140892 A1 7/2004 Hanood
2004/0190289 A1 9/2004 Liu
2004/0190290 A1 9/2004 Zerphy et al.
2004/0233145 A1 11/2004 Chiang
2005/0057187 A1 3/2005 Catalano
2005/0162851 A1 7/2005 Kazar et al.
2006/0007679 A1 1/2006 Allen
2006/0012349 A1 1/2006 Allen
2006/0012997 A1 1/2006 Catalano
2006/0044788 A1 3/2006 Damrau
2006/0098442 A1 5/2006 Yu
2006/0180822 A1 8/2006 Yu
2006/0203482 A1 9/2006 Allen
2006/0270250 A1 11/2006 Allen
2007/0025109 A1 2/2007 Yu
2007/0064450 A1 3/2007 Chiba et al.
2007/0183153 A1 8/2007 Yu
2008/0013324 A1 1/2008 Yu
2008/0024071 A1 1/2008 Yu
2008/0025024 A1 1/2008 Yu
2008/0143234 A1 6/2008 Yu
2008/0157686 A1 7/2008 Chung et al.

OTHER PUBLICATIONS

Non-Final Office Action mailed May 23, 2005, in U.S. Appl. No. 10/767,820, filed Jan. 30, 2004 by Minzhu Li.
Non-Final Office Action mailed Aug. 18, 2008, in U.S. Appl. No. 11/461,293, filed Jul. 31, 2006, by Jing Jing Yu.
Non-Final Office Action mailed May 16, 2008, in U.S. Appl. No. 11/461,293, filed Jul. 31, 2006, by Jing Jing Yu.
Non-Final Office Action mailed Dec. 21, 2007, in U.S. Appl. No. 11/461,293, filed Jul. 31, 2006, by Jing Jing Yu.
Non-Final Office Action mailed Jun. 4, 2007, in U.S. Appl. No. 11/189,066, filed Jul. 26, 2005, by Jing Jing Yu.
Non-Final Office Action mailed Oct. 27, 2008, in U.S. Appl. No. 11/849,939, filed Sep. 4, 2007, by Jing Jing Yu.
Final Office Action mailed Sep. 25, 2008, in U.S. Appl. No. 11/849,939, filed Sep. 4, 2007, by Jing Jing Yu.
Non-Final Office Action mailed Mar. 20, 2008, in U.S. Appl. No. 11/849,939, filed Sep. 4, 2007, by Jing Jing Yu.
Non-Final Office Action mailed Jun. 14, 2007, in U.S. Appl. No. 11/350,343, filed Feb. 9, 20006, by Jing Jing Yu.
Non-Final Office Action mailed Feb. 15, 2007, in U.S. Appl. No. 11/056,148, filed Feb. 14, 2005, by Jing Jing Yu.
U.S. Appl. No. 12/099,034, filed Apr. 7, 2008, by Jing Jing Yu.
U.S. Appl. No. 12/020,373, filed Jan. 25, 2008, by Jing Jing Yu.
U.S. Appl. No. 11/716,788, filed Mar. 12, 2007, by Jing Jing Yu.

U.S. Appl. No. 11/860,298, filed Sep. 24, 2007, by Jing Jing Yu.
U.S. Appl. No. 12/098,423, filed Apr. 5, 2008, by Jing Jing Yu.
U.S. Appl. No. 61/043,262, filed Apr. 8, 2008, by Jing Jing Yu.
U.S. Appl. No. 60/949,804, filed Jul. 13, 2007, by Jing Jing Yu.
"Holiday Lighting: Latest Technology Saves Time, Money and More," Burrelle's Yeadon Times, Yeadon, PA, Nov. 29, 2001.
"New kind of Christmas lights cut electricity use," Luce Press Clippings, Nevada Appeal, Carson City, NV, Dec. 2, 2001.
www.optics.org, The Online Photonics Resource.
http://ledmuseum.home.att.net/xmas1.htm;www.foreverbright.com.
Christmas may be brighter longer, Huntsville Times, Huntsville, Alabama, Dec. 10, 2001.
"Holiday lights that stay ready for action," News Journal, Wilmington Metropolitan Area, Dec. 17, 2001.
"Bulbs that didn't work spur new line of lights," Richmond, Virginia, Times, Dec. 25, 2001.
"Now, let's eliminate tangles too," Sentinel-Tribune, Bowling Green, Ohio, Dec. 22, 2001.
"LED Christmas lights gaining in popularity," Luce Press, Shamokin, Pennsylvania, Dec. 2, 2001.
"It's beginning to look a lot light Christmas," Luce Press, Democrat, Tallahassee, Florida, Dec. 3, 2001.
"LED lights are Christmas option," Luce Press, Herald News, Joliet, Illinois, Nov. 28, 2001.
"A welcome idea for those who string holiday lights," Luce Press, Times, Seattle, Washington, Nov. 29, 2001.
"LEDing the way," Luce Press, Chronicle, Houston, Texas, Dec. 2, 2001.
". . . malfunctioning yule lights," Desert News, Salt Lake City-Ogden Metro Area, Utah, Dec. 9, 2001.
"LED holiday lights catch on," Luce Press, Herald, Sharon, Pennsylvania, Dec. 2, 2001.
"A brighter day for yule lights," Luce Press, Star, Kansas City, Missouri, Dec. 8, 2001.
"LED Lights Giving Off A Christmas Sparkle," "Entrepreneurs Claim LED Technology Better Than Christmas Bulbs," Luce Press, Tribune, Salt Lake City-Ogden, Utah, Dec. 2, 2001.
"New Christmas lights gaining popularity," Luce Press, Intelligencer, Doylestown, Pennsylvania, Nov. 28, 2001.
"Forever Bright," Luce Press, New Jersey Herald, Newton, New Jersey, Nov. 25, 2001.
"Replacements for traditional Christmas lights gaining popularity," Luce Press, Nov. 28, 2001.
"Inventor lights up Christmas," Luce Press, Valley News Dispatch, Tarentum, Pennsylvania, Nov. 25, 2001.
"The Christmas light man," Luce Press, Dominion Post, Morgantown, West Virginia, Nov. 24, 2001.
"LEDs the coolest thing in holiday lights," Luce Press, Press, Atlantic City, New Jersey, Nov. 25, 2001.
"Consumers switch to LED Christmas lights for their reliability," Luce Press, Star-Gazette, Elmira, New York, Dec. 2, 2001.
"All wrapped up," Luce Press, Ledger, Ellwood City, Pennsylvania, Dec. 1, 2001.
"Beating Christmas burnout," Luce Press, Press Enterprise, Bloomsburg, Pennsylvania, Nov. 26, 2001.
U.S. Appl. No. 09/339,616; Inventor: Tuyet Thi Vo; abandoned.
U.S. Appl. No. 09/378,631, Inventor: Tuyet Thi Vo; abandoned.

* cited by examiner

Fig. 7A
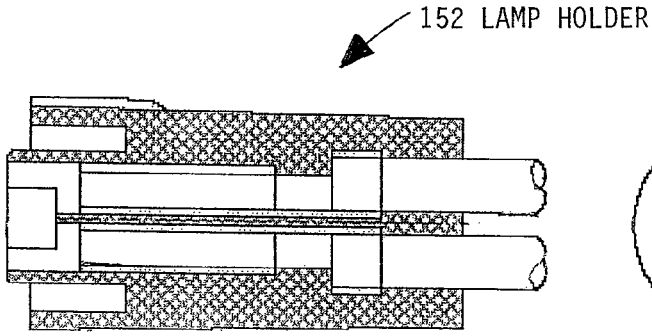
Fig. 7B
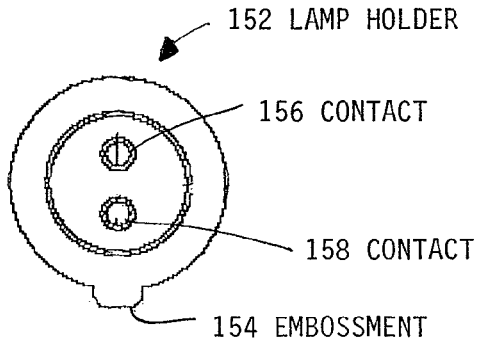
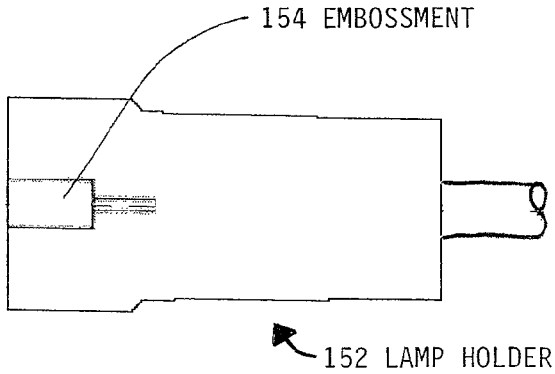
Fig. 7C

Fig. 17A
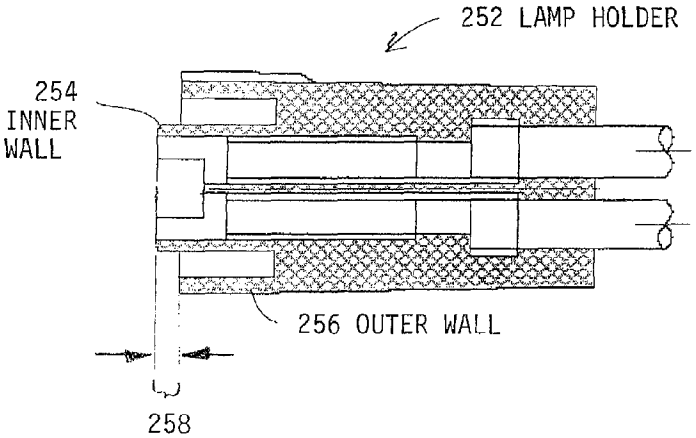
Fig. 17B
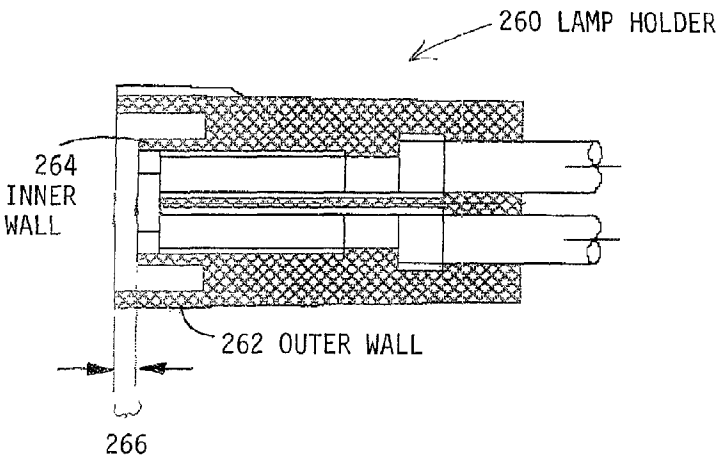
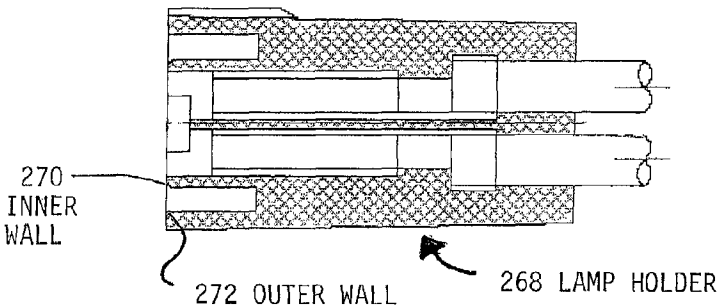
Fig. 17C

Fig. 18A
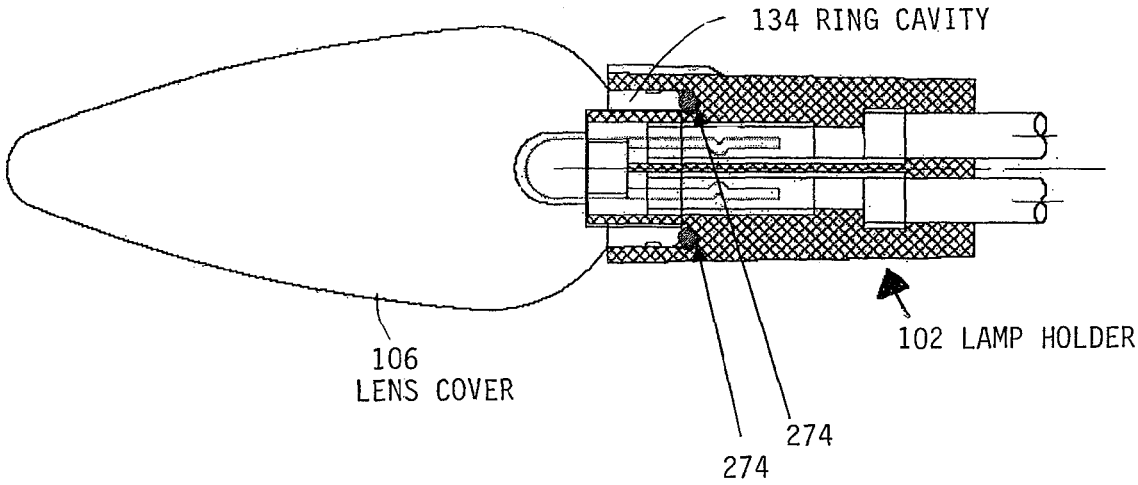
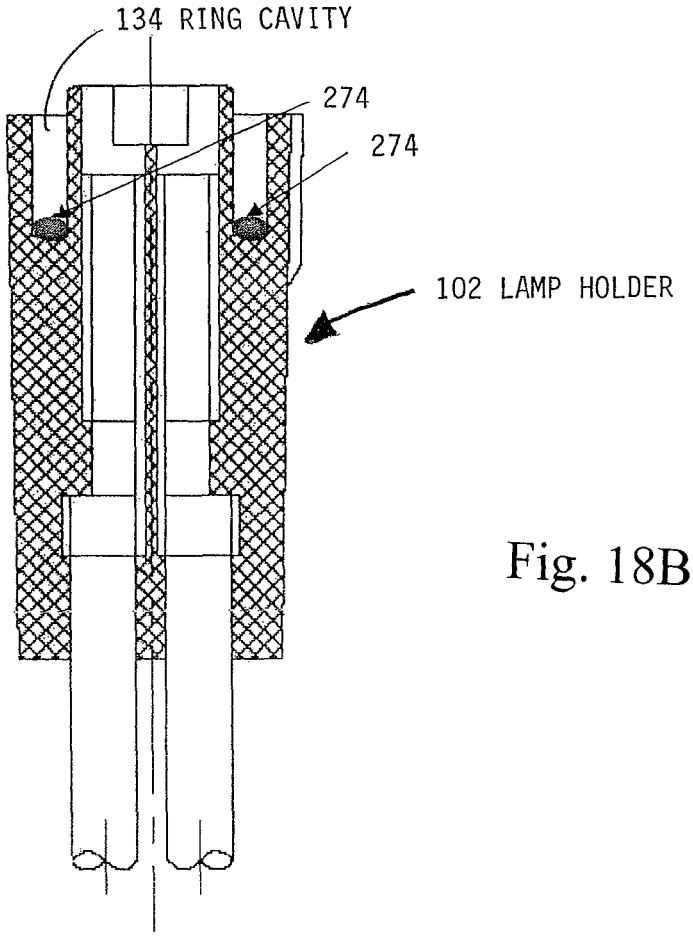
Fig. 18B

WATERTIGHT LED LAMP

CROSS-REFERENCE TO RELATED APPLICATION

The present application claims priority to and benefit of U.S. Provisional Application Ser. No. 60/949,804, filed Jul. 13, 2007, by Jing Jing Yu entitled "Watertight LED Lamp," the entire contents of which are hereby specifically incorporated by reference for all it discloses and teaches.

BACKGROUND OF THE INVENTION

Light emitting diodes have been widely implemented as an alternative to traditional incandescent and fluorescent lamps, especially for decorative light strings. Light emitting diodes have high efficiency, a long lifetime and a low cost. Christmas light strings need to operate in both an indoor and outdoor environment. As such, watertight light strings are required for safety reasons and to provide an extended lifetime.

SUMMARY OF THE INVENTION

An embodiment of the present invention comprises a watertight, light emitting diode lamp comprising: a lens cover having an annular neck that forms a lens cover opening; a light emitting diode having at least two light emitting diode leads, the leads having a crimp formed therein so as to create contact surfaces on the light emitting diode leads; a lamp holder comprising: at least two light emitting diode sockets that have conductive socket contact surfaces that are releasably engaged by the contact surfaces on the light emitting diode leads, so that the light emitting diode can be replaced; at least two wire connectors that are conductively connected to the light emitting diode socket conductors and to at least two power leads; a housing comprising a plastic insulating material that surrounds and encloses the light emitting diode sockets, the light emitting diode socket conductors and the wire connectors to seal the light emitting diode sockets, the light emitting diode socket conductors and the wire connectors from moisture and provide electrical isolation between the light emitting diode sockets, the light emitting diode socket conductors and the wire connectors, the plastic insulating material formed to provide an inner annular wall and an outer annular wall that create a ring cavity having a size that substantially matches the annular neck of the lens cover to form a watertight seal between the lens cover and the lamp holder.

Another embodiment of the present invention comprises a method of manufacturing an light emitting diode lamp comprising: molding an insulating plastic housing around at least two light emitting diode sockets that have conductive socket contact surfaces, at least two light emitting diode socket conductors that are conductively connected to the light emitting diode sockets and at least two wire connectors that are conductively connected to the light emitting diode socket connectors and to at least two power leads, to provide an insulated housing that seals the light emitting diode sockets, the light emitting diode socket conductors and the wire connectors from moisture and provides electrical isolation between the light emitting diode sockets, the light emitting diode socket conductors and the wire connectors; forming an inner annular wall in the housing; forming an outer annular wall in the housing that creates a ring cavity between the inner annular wall and the outer annular wall that has a pre-selected size; providing an light emitting diode that has at least two light emitting diode leads; forming a crimp in the light emitting diode leads that create contact surfaces on the light emitting diode leads; inserting the light emitting diode leads into the light emitting diode sockets such that the contact surfaces of the light emitting diode leads slidingly and releasably engage the light emitting diode sockets to provide a conductive contact between the light emitting diode leads and the light emitting diode sockets while allowing the light emitting diode to be removed and replaced with another light emitting diode; inserting a lens having an annular neck into the ring cavity such that at least one contact surface of the neck forms a watertight seal with the housing.

BRIEF DESCRIPTION OF THE DRAWINGS

FIGS. 7A-7C illustrate one embodiment of a socket structure.

FIGS. 12A and 12 B illustrate another embodiment of a socket structure.

FIGS. 17A-17C illustrate three different embodiments of a lamp holder.

FIGS. 18A and 18B illustrate the use of waterproof o-ring seals in the ring cavity.

DETAILED DESCRIPTION OF THE EMBODIMENTS

Figure 1:
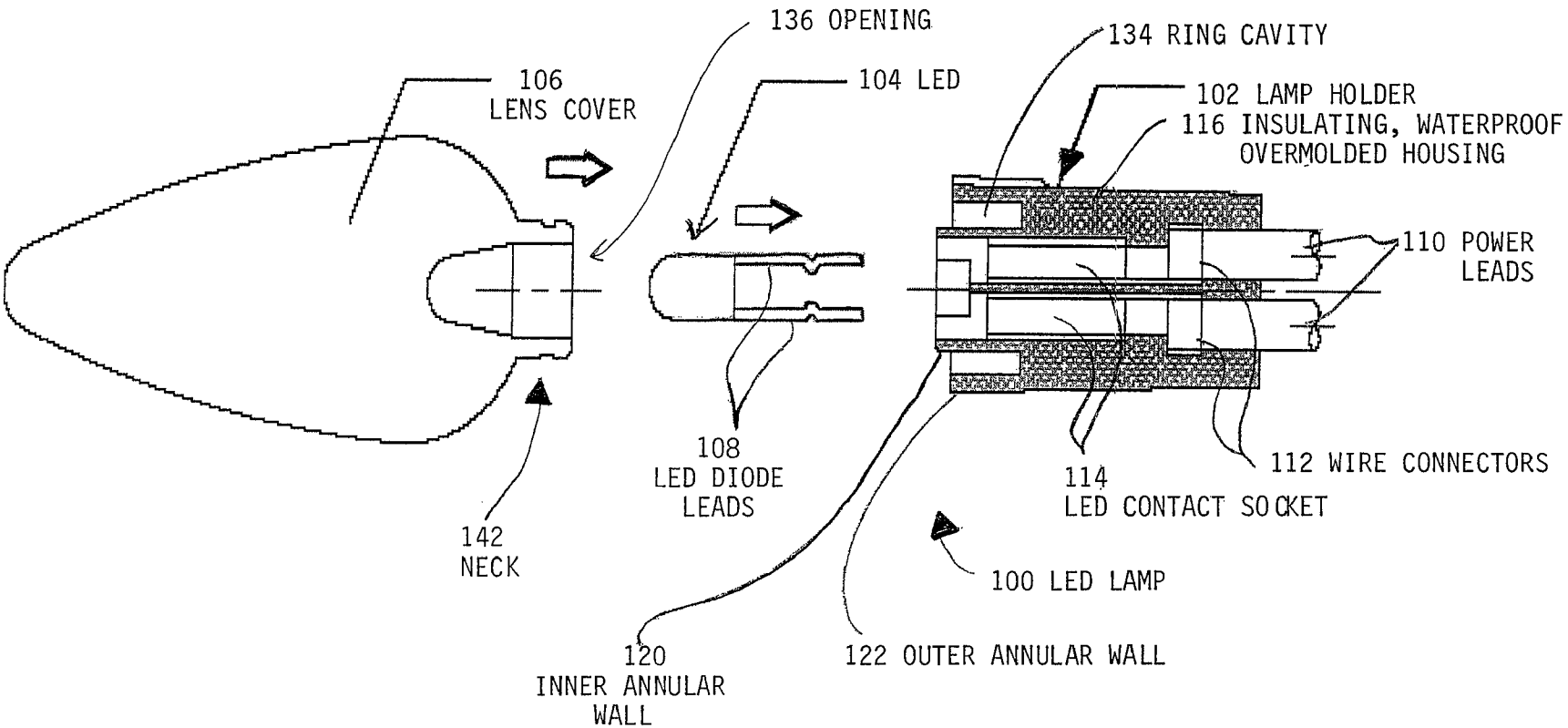
FIG. 1 is an assembly drawing of one embodiment of a light emitting diode lamp.

FIG. 1 is an assembly diagram of one embodiment of a light emitting diode lamp 100. As shown in FIG. 1, the light emitting diode lamp 100 is comprised of three primary parts: a lamp holder 102, a light emitting diode 104 and a lens cover 106. These three primary elements are assembled to provide a watertight lamp 100 that is suitable for use on either indoor or outdoor light strings. The lamp holder 102 includes an insulating, waterproof over-molded housing 116 that covers all of the electrical components and wire connections of the lamp holder 102. The housing 116 can be made from a plastic or rubberized type material that can be molded directly over the other components in the lamp holder 102. The over-molded housing 116 provides a waterproof package that securely holds all of the components of the lamp holder 102. The over-molded housing 116 also covers the power leads 110 and prevents moisture from entering the lamp holder 102. The power leads 110 are connected by wire connectors 112 to the light emitting diode contact sockets 114. A portion of the insulating, waterproof over-molded housing 116 separates each of the light emitting diode contact sockets 114 and provides electrical insulation between the sockets 114. The insulating, waterproof over-molded housing 116 is formed with an inner annular wall 120 and an outer annular wall 122 that provide an annular ring cavity 134. The light emitting diode 104 has two light emitting diode leads 108 that fit into the light emitting diode contact sockets 114 in the lamp holder 102. The lens cover 106 has a neck 142 with an opening 136 that fits over the light emitting diode 104. The neck 142 fits into the ring cavity 134 and provides a tight waterproof seal between the neck 142 of the lens cover 106 by forming a seal between the neck 14 and the inner annular wall 120 and the outer annular wall 122.

The three primary components of the light emitting diode lamp 100, comprising the lamp holder 102, the light emitting diode 104 and the lens cover 106, can be easily assembled and disassembled by hand. The assembled light emitting diode lamp 100 provides a watertight package that allows replacement of the light emitting diode 104 in cases where the light emitting diode 104 burns out, or the user desires to replace the light emitting diode 104 with a different color light emitting diode or a different wattage light emitting diode. The neck 142 of the lens cover 106 fits tightly in the ring cavity 134 such that the elasticity of the over-molded plastic material 116 tightly holds the lens cover 106 to the lamp holder 102 with a force that is sufficient to prevent the disassembly of the lens cover 106 from the lamp holder 102 during normal usage of the light emitting diode lamp 100. Alternatively, as disclosed below, with respect to FIGS. 17A and 17B, the lens cover 106 can be threaded into threads in the ring cavity 134 to securely hold the lens cover 106 to the lamp holder 102.

Figure 2:
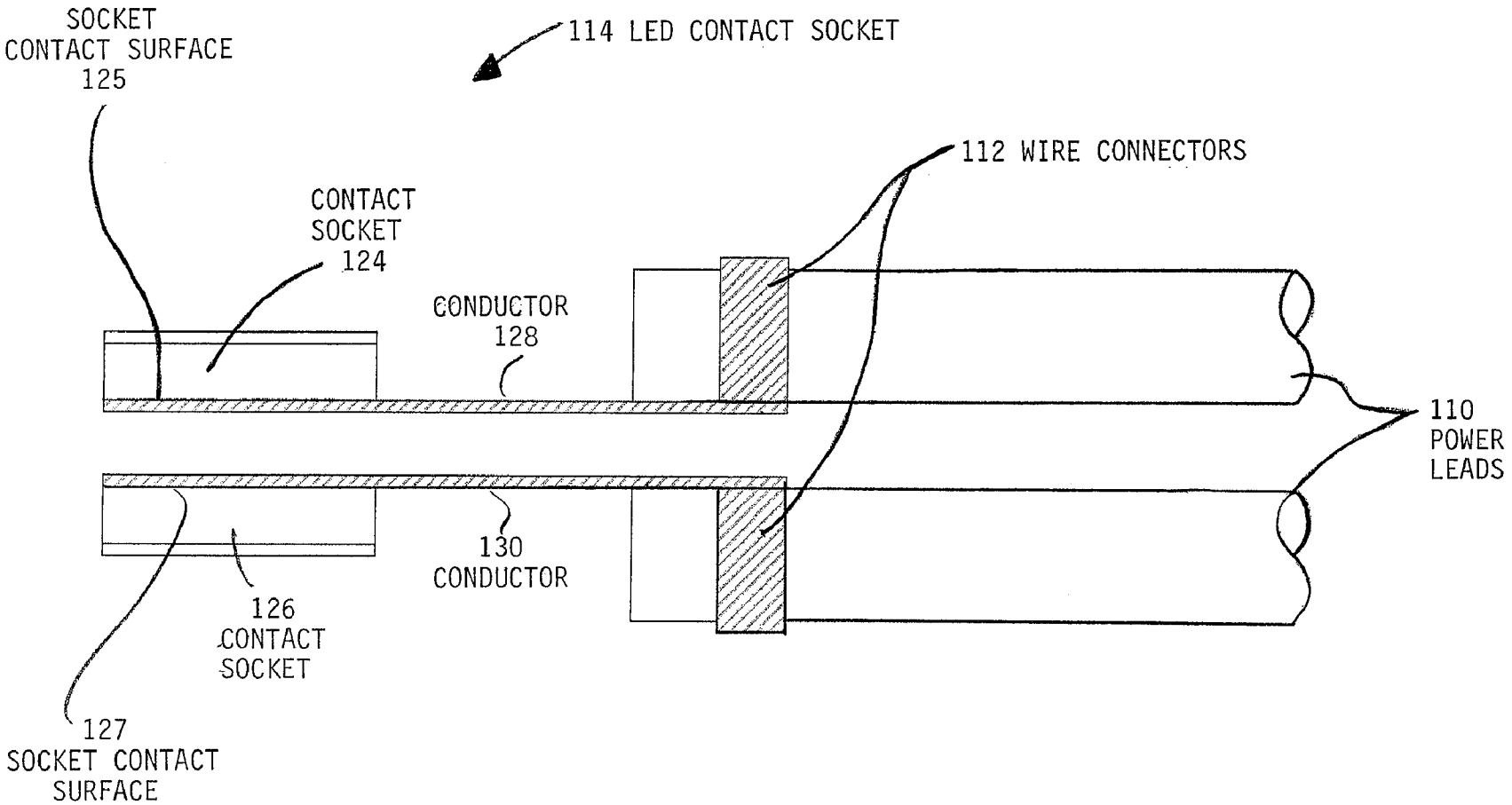
FIG. 2 is a schematic illustration of two light emitting diode contact sockets of one embodiment of the light emitting diode lamp.

FIG. 2 is a schematic diagram of two light emitting diode contact sockets 114 connected to two power leads 110. As shown in FIG. 2, contact socket 124 is conductively connected to the wire conductor 112 via conductor 128. Similarly, contact socket 126 is connected to another one of the wire connectors 112 via conductor 130. Contact socket 124 includes a socket contact surface 125 that engages a contact surface 138 on one of the light emitting diode leads 108, as disclosed below with respect to FIG. 4. Similarly, contact socket 126 has a socket contact surface 127 that engages a contact surface 139 on the other light emitting diode lead 108, as explained in more detail below with respect to FIG. 4.

Figure 3:
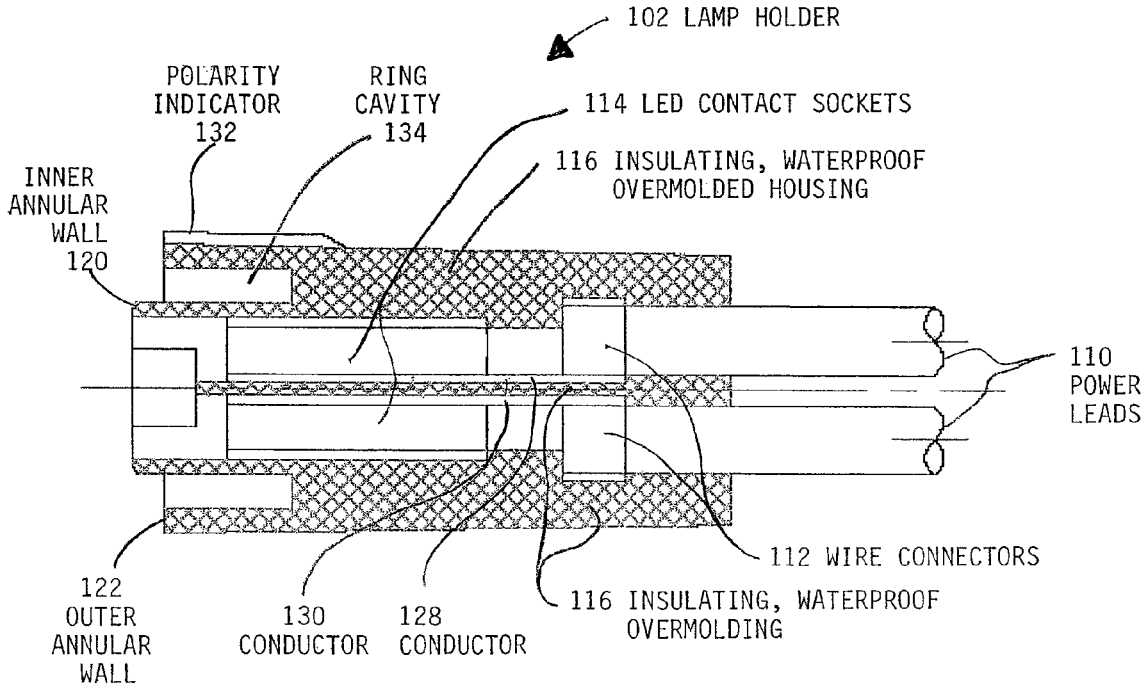
FIG. 3 is a schematic cutaway diagram of a lamp holder of one embodiment.

FIG. 3 discloses a lamp holder 102. Lamp holder 102 has an insulating waterproof molded housing 116 that surrounds and encapsulates light emitting diode contact sockets 114, wire connectors 112 and conductors 128, 130. Power leads 110 are also surrounded by the insulating, waterproof over-molded housing 116 that are sealed in the housing 116 to prevent leakage of moisture that could cause corrosion. The insulating, waterproof over-molded housing 116 is also disposed between the light emitting diode contact sockets 114, the conductors 128, 130 and the wire connectors 112 to provide an insulating layer between these components. An outer annular wall 122 is formed in an outer portion at one end of the insulating, waterproof over-molded housing 116. An inner annular wall 120 is created inside of the outer annular wall 122 and protrudes from the housing 116 to form a ring cavity 134 in the housing 116. A polarity indicator 132 is also provided on the outside of the lamp holder 102 to indicate the proper polarity for the light emitting diode 104.

Figure 4:
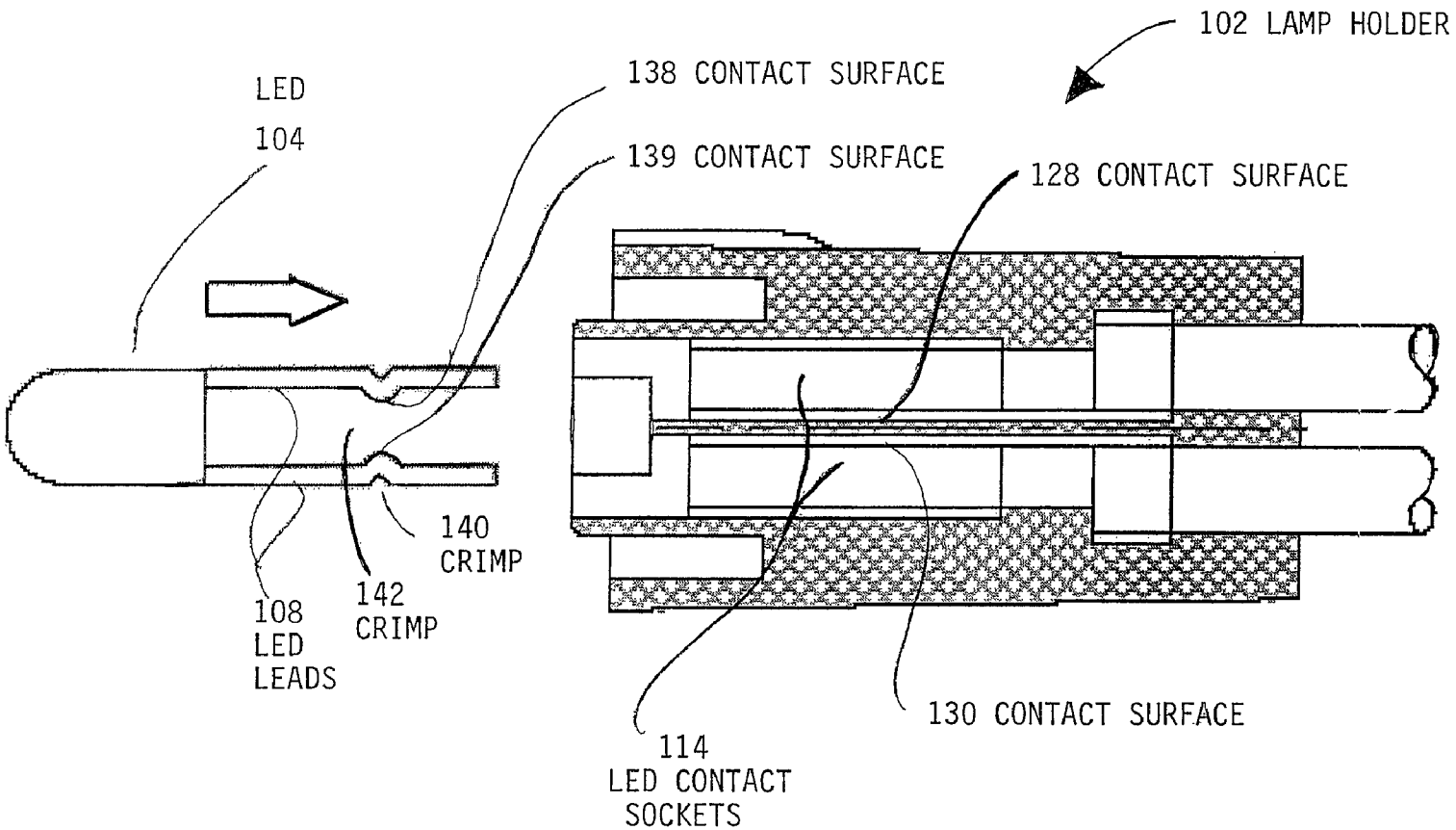
FIG. 4 is an assembly diagram of a lamp holder and a light emitting diode.

FIG. 4 is an assembly diagram illustrating assembly of a lamp holder 102 with a light emitting diode 104. As shown in FIG. 4, light emitting diode 104 has two light emitting diode leads 108. Crimps 140, 142 are formed in the light emitting diode leads 108 to create contact surfaces 138, 139, respectively. The contact surfaces 138, 139 are adapted to engage contact surfaces 128, 130, respectively, when the diode 104 is inserted into the light emitting diode contact sockets 114. The light emitting diode leads 108 have sufficient elasticity to create a force between the contact surfaces 138, 139 and the contact surfaces 128, 130 to ensure sufficient electrical conduction to drive an adequate current through the light emitting diode leads 108 to light the light emitting diode 104.

Figure 5:
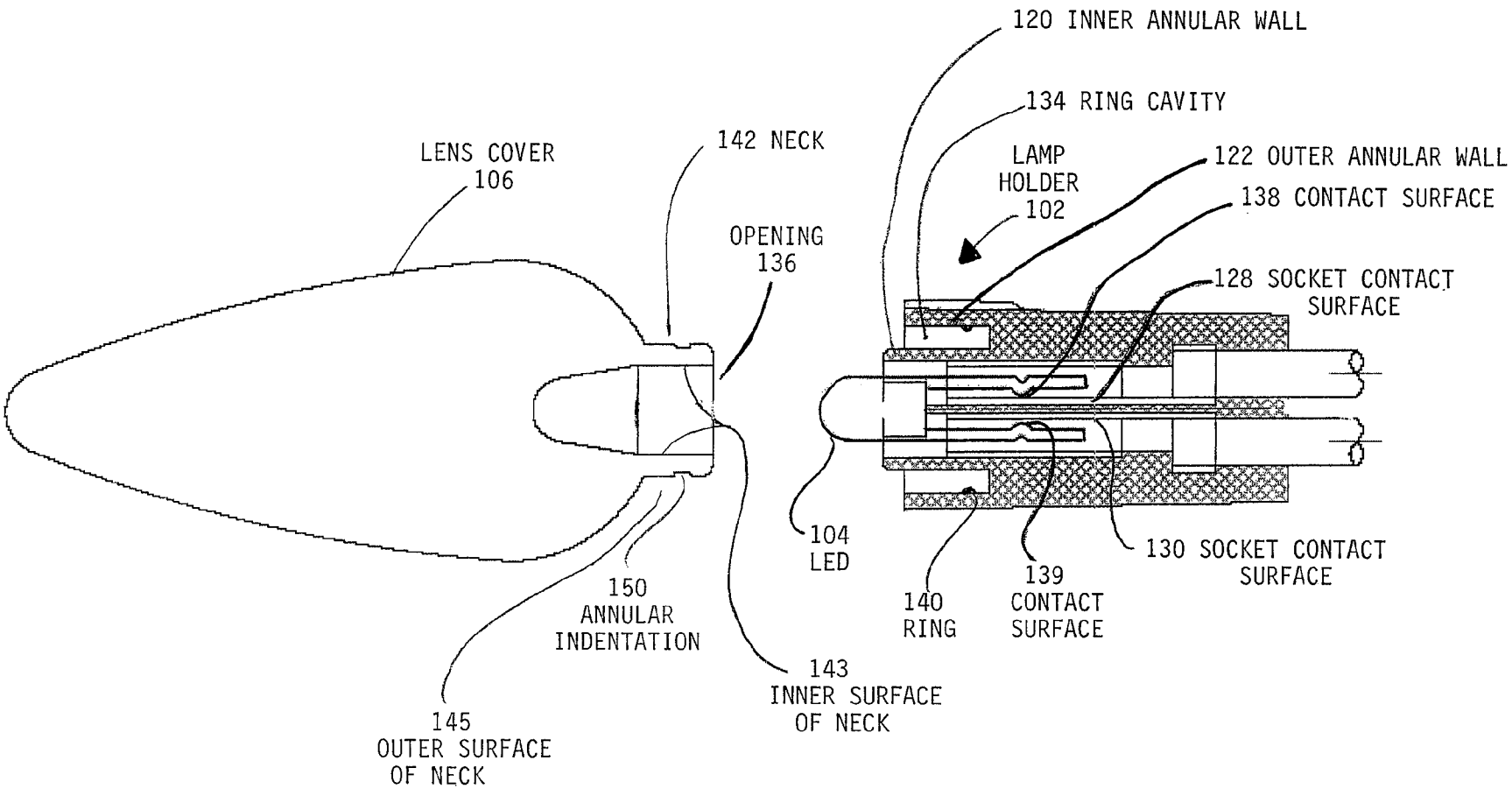
FIG. 5 is an assembly diagram of a lamp holder and a light emitting diode lens cover.

FIG. 5 is an assembly diagram illustrating the manner in which a lamp holder 102 can be assembled with lens cover 106. As shown in FIG. 5, the light emitting diode 104 is inserted into the light emitting diode contact sockets 114, such that the light emitting diode lead contact surfaces 138, 139 engage the socket contact surfaces 128, 130, respectively. Lens cover 106, as shown in FIG. 5, includes a neck 142 having an opening 136, which is large enough to accommodate the light emitting diode 104. The neck 142 is substantially the same size as the ring cavity 134 and fits tightly into the ring cavity 134. The outer surface of the neck 145 creates a seal with the inner surface of the outer annular wall 122. Similarly, the inner surface of the neck 143 creates a seal with the outer surface of the inner annular wall 120. Opening 136 covers the light emitting diode 104. An annular indentation 150 may also engage an optional ring 134 that is connected to the outer annular wall 122. The ring 140 causes the neck 142 of the lens cover 106 to snap into place so that the annular indentation 150 engages the ring 140. Ring 140 can be formed as part of the structure of the outer annular wall 122.

Figure 6:
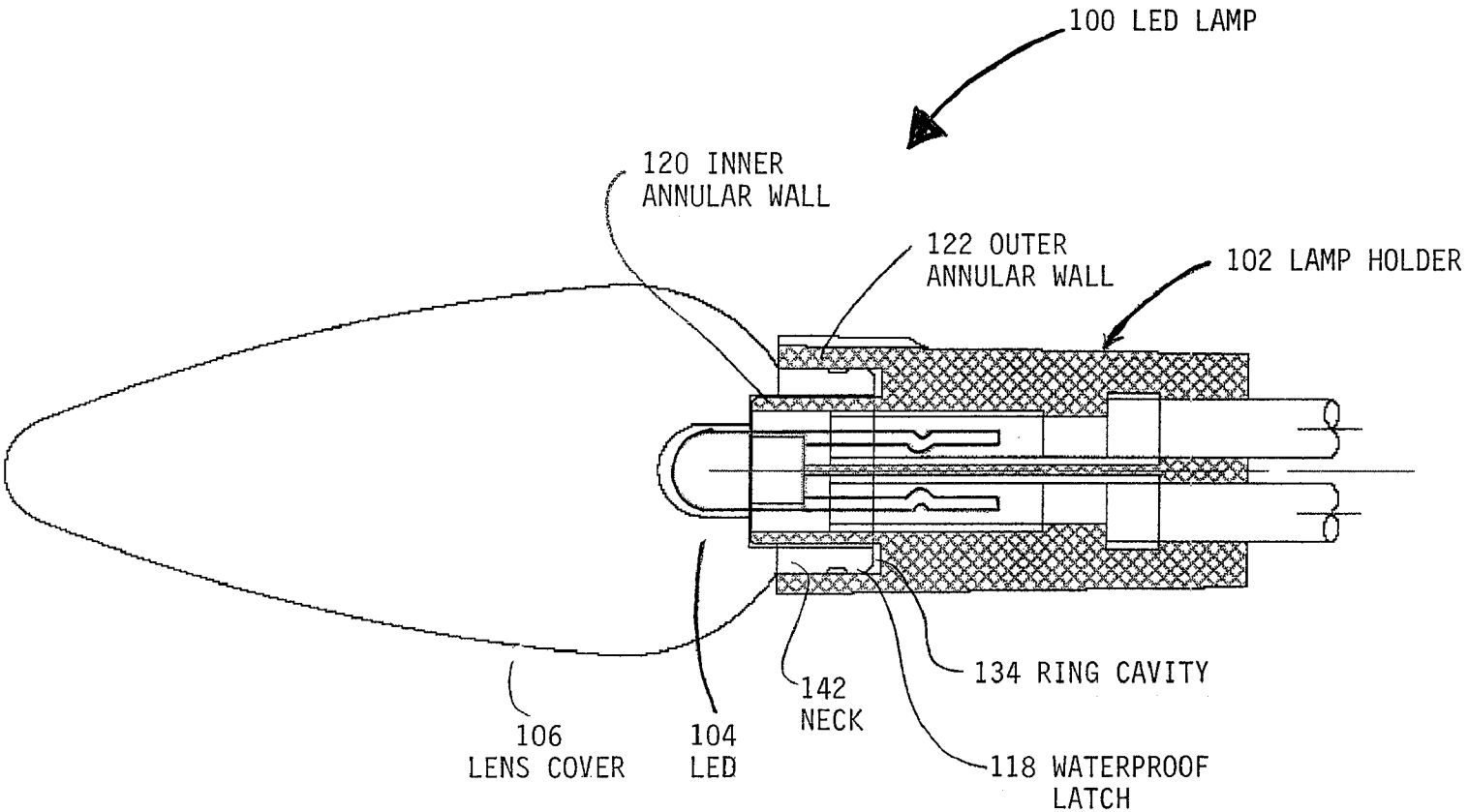
FIG. 6 is a diagram of an assembled light emitting diode lamp.

FIG. 6 is a diagram of an assembled light emitting diode lamp 100. As shown in FIG. 6, the lens cover 106 is inserted into the ring cavity 134 between the inner annular wall 120 and the outer annular wall 122. Neck 142 forms a seal with the outer annular wall 122 and the inner annular wall 120. The inner annular wall 120 extends outwardly from the lamp holder 122 to engage a larger portion of the neck 142 of the lens cover 106 to increase the sealing surface that is created between the lens cover 106 and the lamp holder 102. A waterproof latch 118 may be used to increase the pressure between the inside surface of the outer annular wall 122 and the neck 142 to increase the sealing properties between neck 142 and outer annular wall 122.

FIGS. 7A-7C show another embodiment of lamp holder 152. FIG. 7A is a side cutaway view of lamp holder 152. As shown in FIG. 7B, the embossment 154 provides a label to label the polarity of the contacts 156, 158. FIG. 7C is a side view of the lamp holder 152 illustrating the manner in which the embossment 154 is disposed on the lamp holder 152.

Figure 8B:
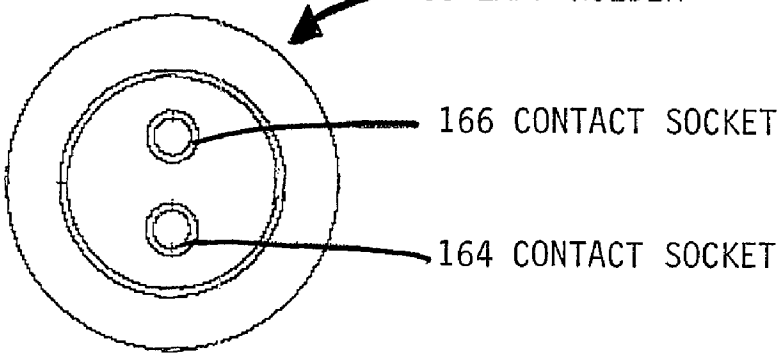
FIGS. 8A and 8B illustrate another embodiment of a socket structure.
Figure 8A:
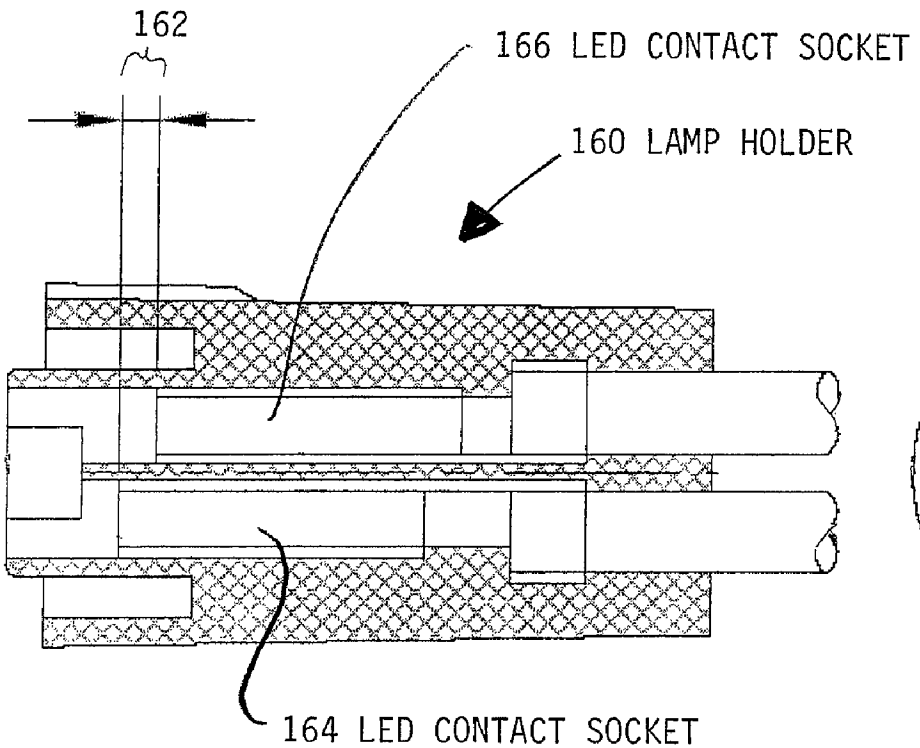

FIGS. 8A and 8B disclose another embodiment of a lamp holder 160. As shown in FIG. 8A, light emitting diode contact socket 166 is placed in a rearward position from the light emitting diode contact socket 164. The light emitting diode contact sockets 164, 166 are displaced by a distance 162. FIG. 8B is an end view showing the contact sockets 164, 166 in the lamp holder 160. Light emitting diodes (not shown) having different length leads can then be used with the lamp holder 160 to ensure proper polarity when the light emitting diode is inserted into the light emitting diode contact sockets 164, 166.

Figure 9B:
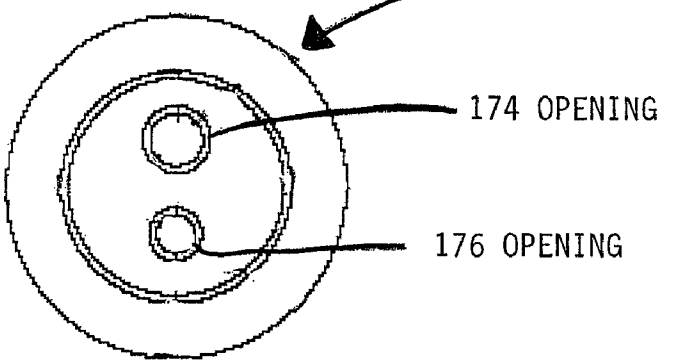
FIGS. 9A and 9B illustrate another embodiment of a socket structure.
Figure 9A:
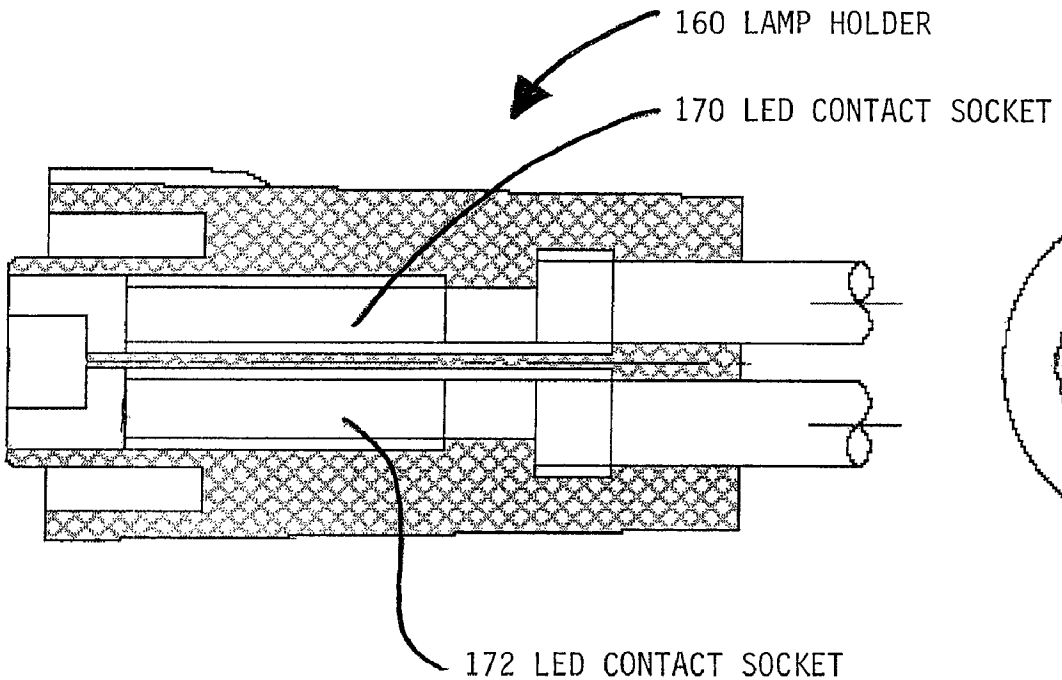

FIGS. 9A and 9B illustrate an alternative embodiment of a lamp holder 168. As shown in FIG. 9A, lamp holder 168 includes a light emitting diode contact socket 170 and a light emitting diode contact socket 172. As shown in FIG. 9B, openings 174, 176 are provided in the lamp holder 168 that are different sizes. The leads of a light emitting diode (not shown) can be made to have different sizes to fit the openings 174, 176 to ensure proper polarity when inserting the light emitting diode. Alternatively, the light emitting diode sockets 170, 172 can be made different sizes to ensure the proper polarity.

Figure 10B:
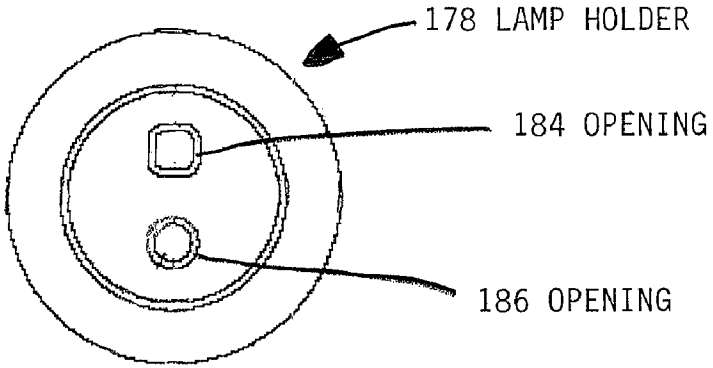
FIGS. 10A and 10B illustrate another embodiment of a socket structure.
Figure 10A:
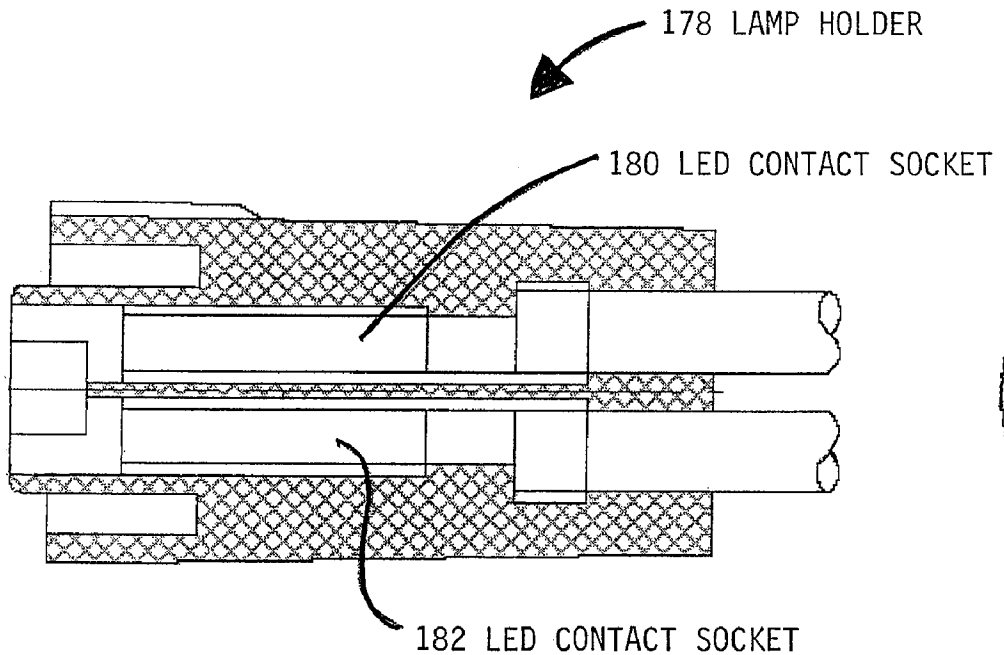

FIGS. 10A and 10B show another embodiment of a lamp holder 178. As shown in FIG. 10A, lamp holder 178 includes light emitting diode sockets 180, 182. As shown in FIG. 10B, openings 184, 186 can be of a square shape and a round shape, respectively. The leads of a light emitting diode (not shown) can then be formed to match the openings 184, 186 to ensure proper polarity upon insertion of the light emitting diode. Alternatively, the light emitting diode sockets 180, 182 can be made in the shape of the openings 184, 186.

Figures 11A, 11B:
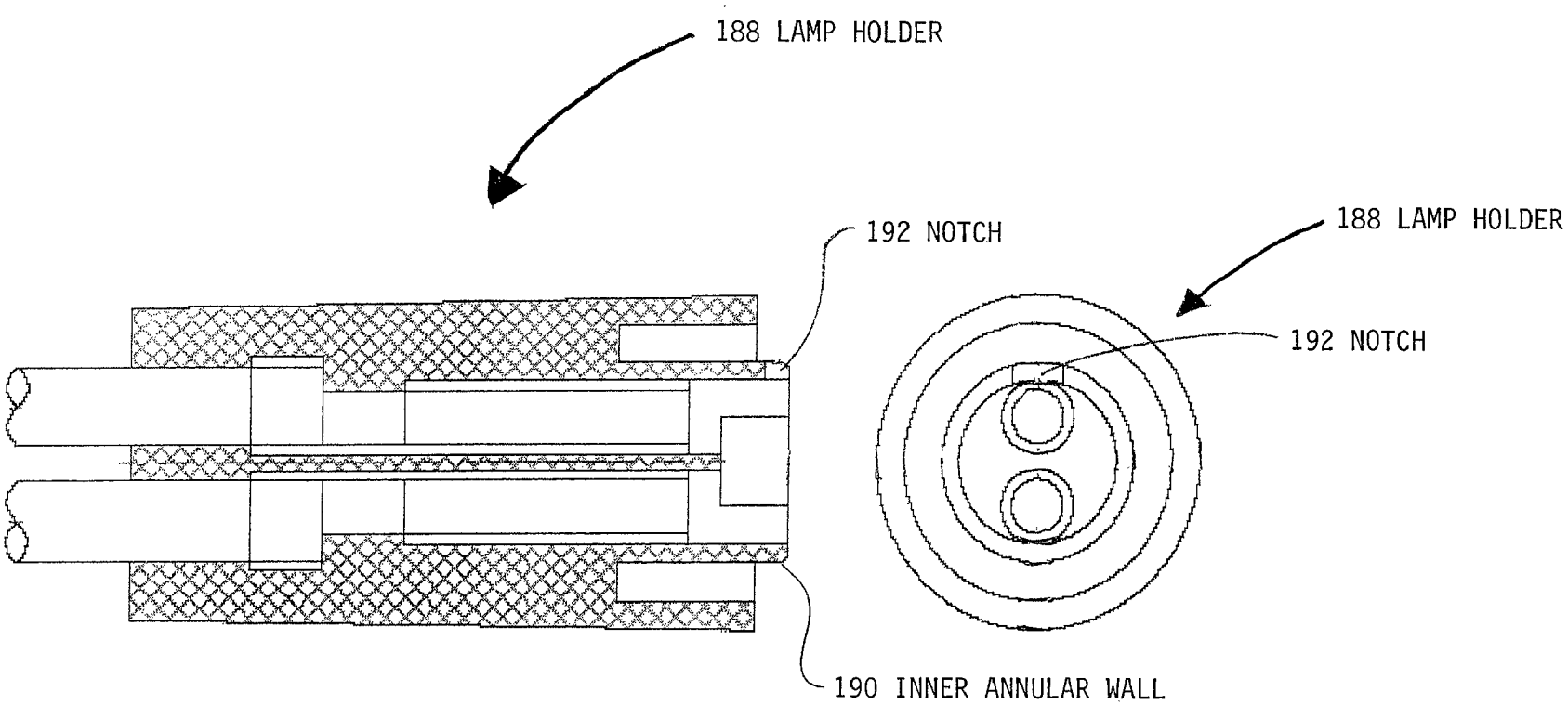
FIGS. 11A and 11B illustrate another embodiment of a socket structure.

FIGS. 11A and 11B disclose another embodiment of a lamp holder 188. As shown in FIGS. 11A and 11B, a notch 192 is provided in the inner annular wall 190. A protrusion extending from a light emitting diode (not shown) can be used to match the notch 192 to ensure the proper polarity when inserting the light emitting diode.

Figures 12A, 12B:
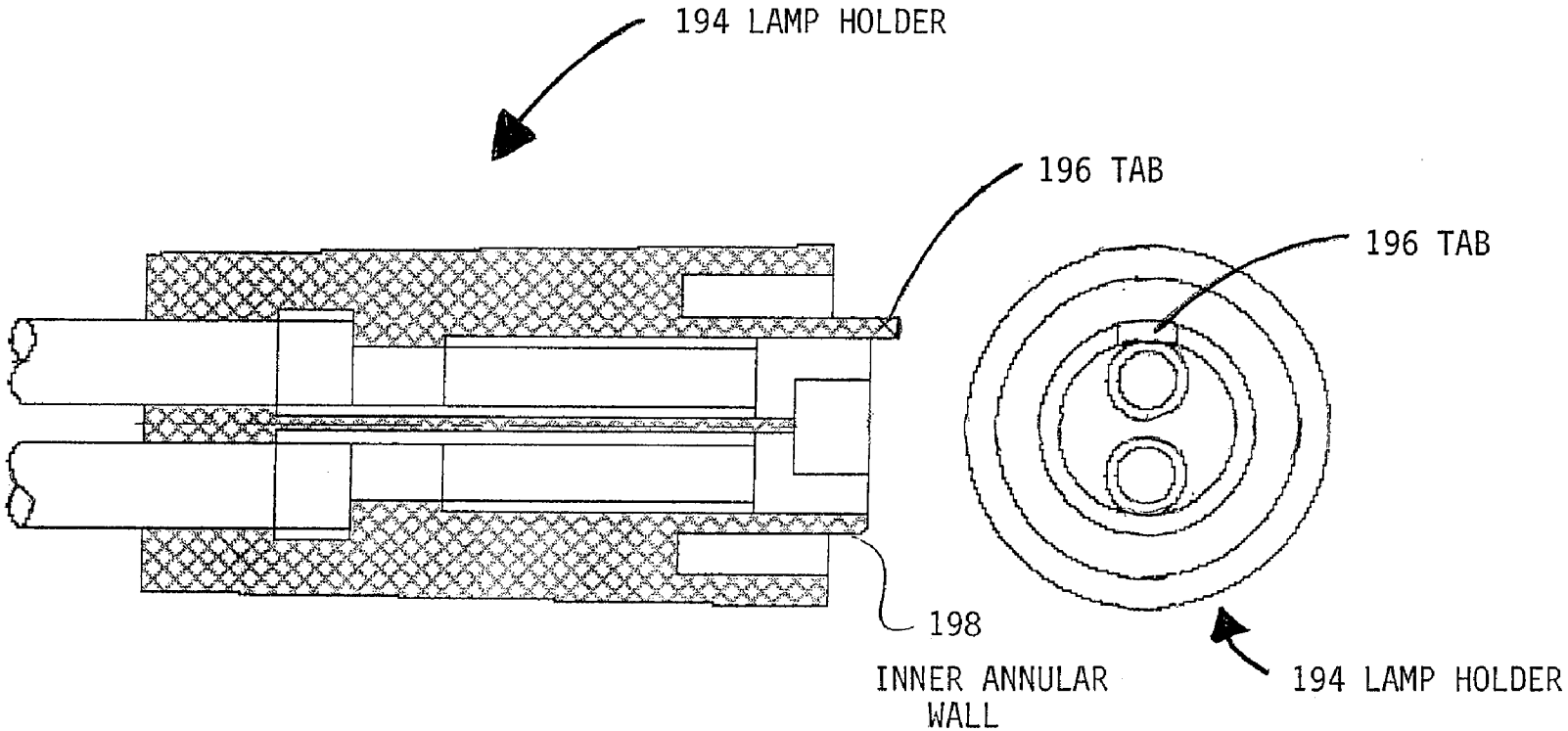

FIGS. 12A and 12B illustrate another embodiment of a lamp holder 194. As shown in FIGS. 12A and 12B, a tab 196 is provided on a portion of the inner annular wall 198. A light emitting diode (not shown) can have a notch that matches the tab 196 to ensure that the light emitting diode is inserted with the proper polarity.

Figure 13:
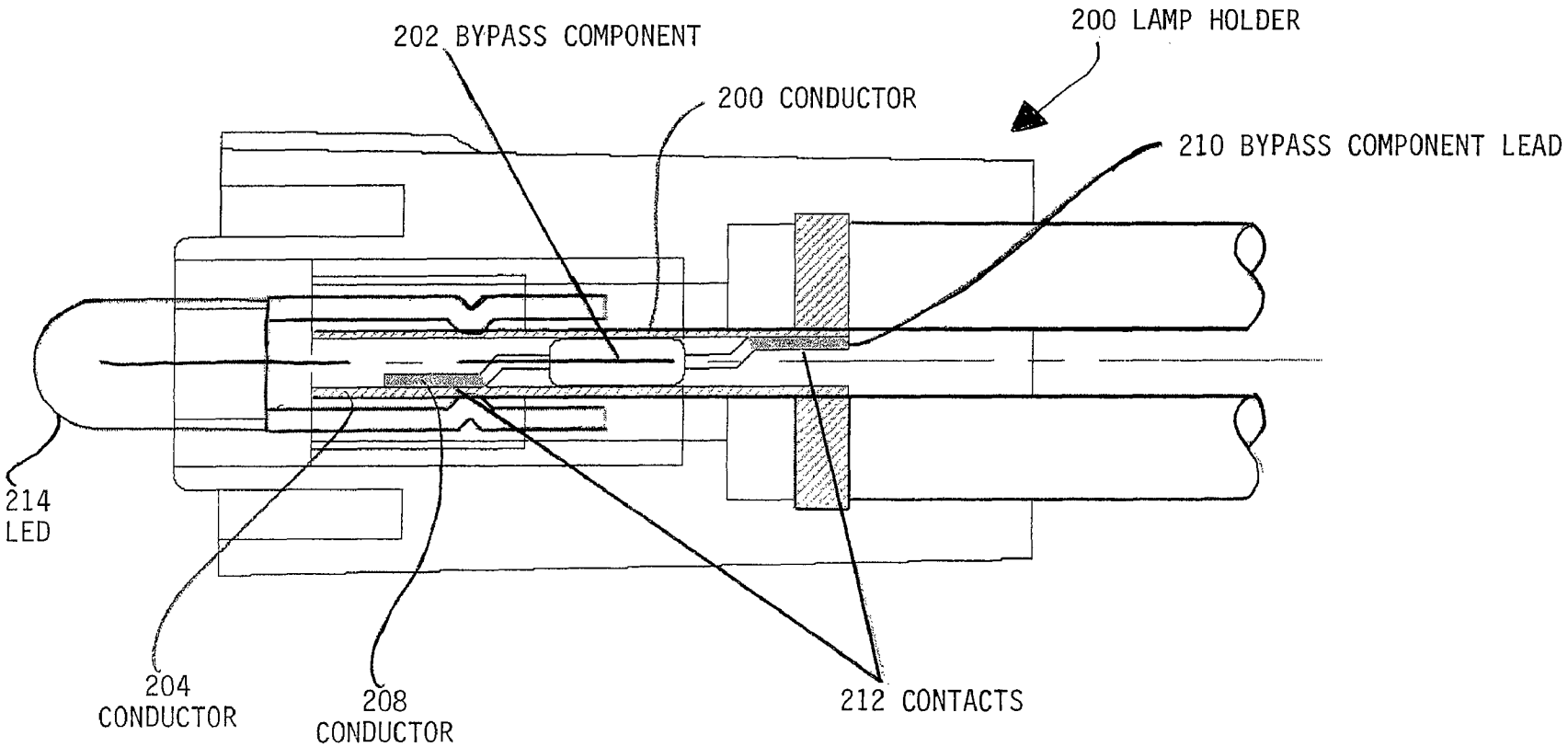
FIG. 13 is a cutaway diagram illustrating a bypass component disposed in a lamp holder housing.

FIG. 13 illustrates another embodiment of a lamp holder 200. In traditional light emitting diode lighting strings, light emitting diodes are normally collected in series. If one light emitting diode in the string burns out or is broken, the entire string will fail. To improve the light emitting diode string reliability, bypass components, such as bypass component 202, can be connected between the leads of the light emitting diode that are burned out or broken to provide a bypass around the light emitting diode 214. Bypass component leads 208, 210 can be connected to conductors 204, 206 at contact points 212. In this manner, a bypass component 202 can be disposed between the conductors 204, 206 of the light emitting diode contact sockets and provide an inexpensive and compact manner of providing a bypass component 202. The bypass component may comprise a resistor, a diode or a resistor-like component. This is disclosed in more detail in U.S. patent application Ser. No. 11/461,293, filed Jul. 31, 2006, by Jing Jing Yu, entitled "Parallel Serial LED Light String," which is specifically incorporated herein by reference for all that it discloses and teaches.

Figure 14:
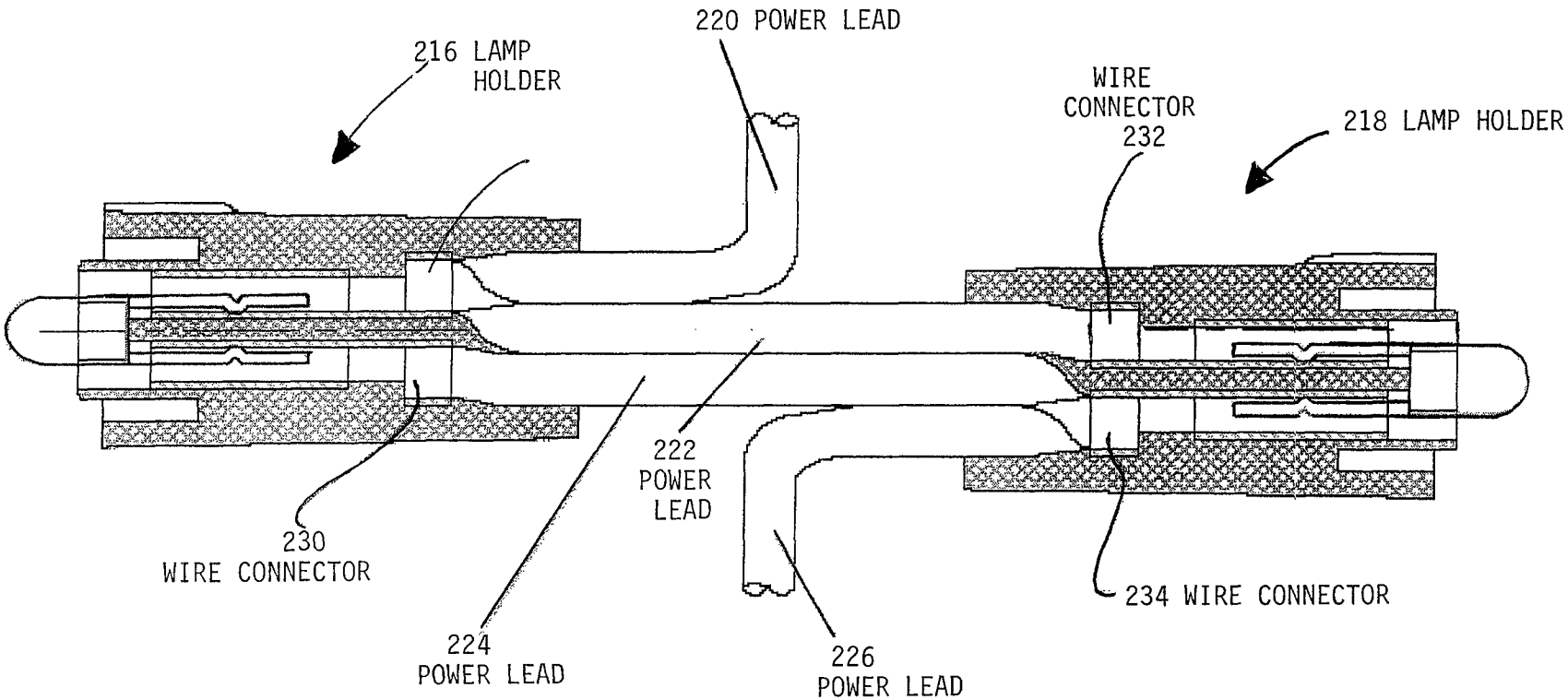
FIG. 14 is a schematic cutaway diagram of two light emitting diode lamp holders that are wired in parallel.

FIG. 14 is a schematic illustration of the manner in which a lamp holder 216 can be connected in a parallel fashion to lamp holder 218. As illustrated in FIG. 14, power lead 220 as well as power lead 222 are connected to a first wire holder 228 of lamp holder 216. Power lead 222 is then connected to a first wire connector 232 of lamp holder 218. Power lead 224 is connected to a second wire connector 230 of lamp holder 216. Power leads 224, 226 are connected to wire connector 234 so that lamp holder 216, 218 are effectively wired in parallel. This is more fully disclosed in U.S. patent application Ser. No. 10/767,820, filed Jan. 30, 2004, by Mingzhu Li, et al., entitled "LED Light Module and Lighting String" and U.S. patent application Ser. No. 11/716,788, filed Mar. 12, 2007, by Jing Jing Yu, entitled "A Half-Wave Rectification Circuit with a Low-Pass Filter for LED Light Strings," which applications are specifically incorporated herein by reference for all that they disclose and teach. The advantage of the parallel wiring scheme illustrated in FIG. 14 is that if a light emitting diode of either lamp holder 216 or 218 burns out, the remaining lights in the string will not burn. Wire connectors 228, 230, 232 and 234 are capable of engaging either one or two wires so that the parallel wiring scheme of FIG. 14 can be achieved.

Figure 15:
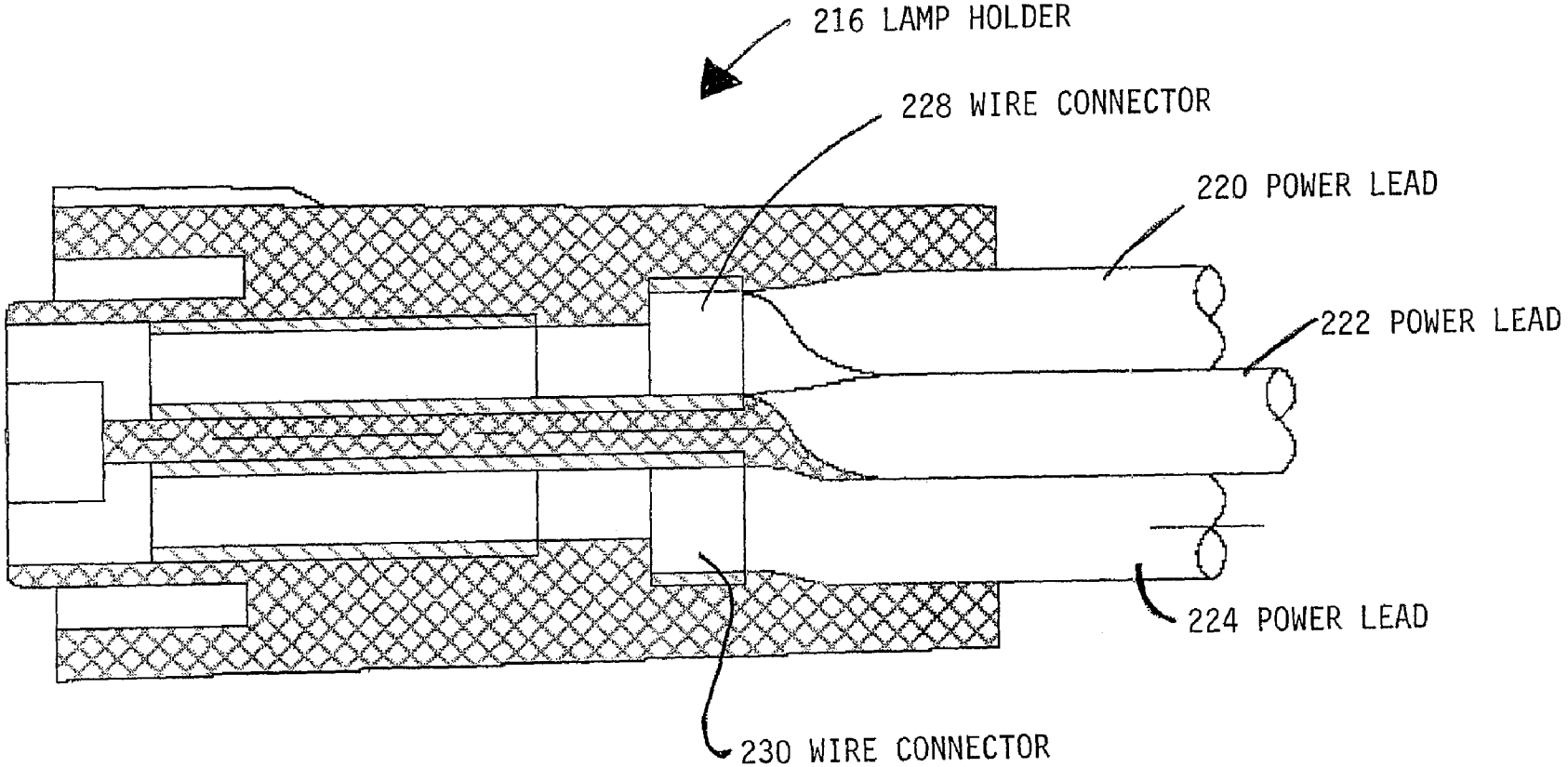
FIG. 15 is a schematic close-up view of a cutaway of a light emitting diode lamp holder that is connected with three wires for parallel wiring.

FIG. 15 is another diagram of the lamp holder 216 showing the manner in which power leads 220, 222 are connected to wire connector 228, and power lead 224 is connected to wire connector 230.

Figure 16A:
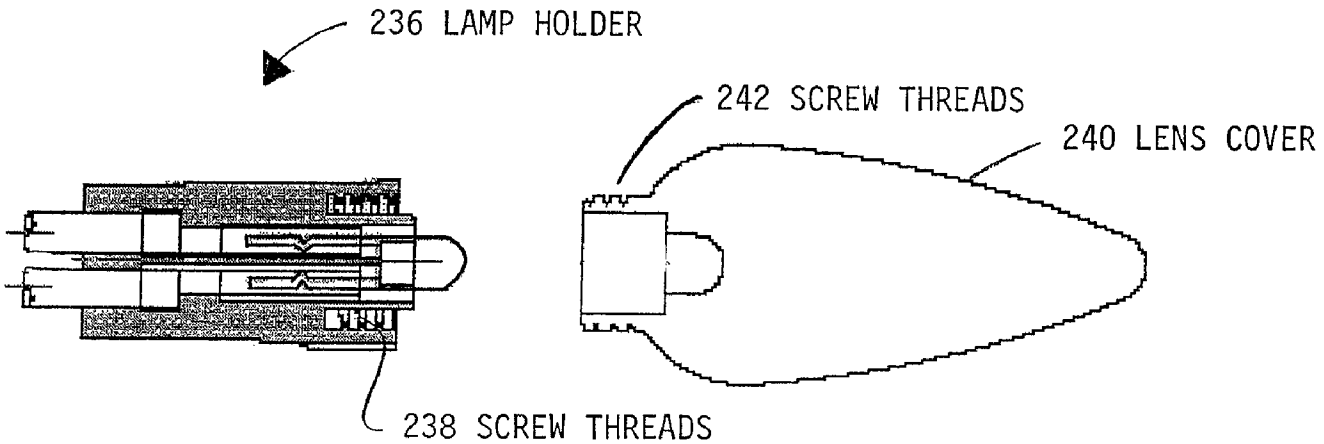
FIGS. 16A and 16B illustrate two different embodiments for connecting a lens cover to a lamp holder.
Figure 16B:
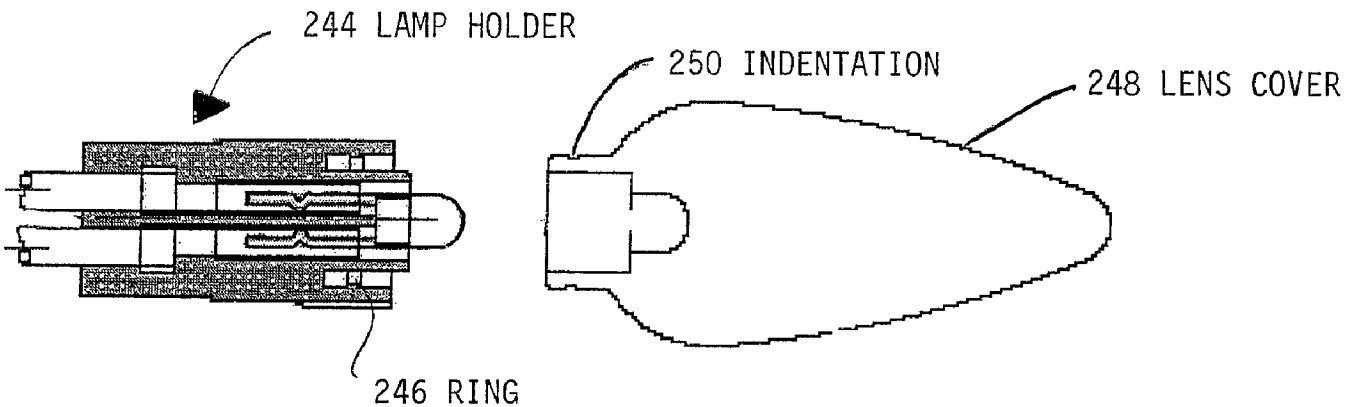

FIGS. 16A and 16B illustrate two different methods for attaching lens covers to lamp holders. As shown in FIG. 16A, lamp holder 236 includes screw threads 238 in the annular ring which match the screw threads 242 that are formed in the neck of the lens cover 240. In this manner, the lens cover 240 can be screwed into the lamp holder 236 and held securely in the lamp holder 236.

As shown in FIG. 16B, the lamp holder 244 includes a ring 246 in the ring cavity that matches the indentation 250 in the neck of the lens cover 248. When the lens cover 248 is inserted into the ring cavity, the ring 246 engages the indentation 250 to securely hold the lens cover 248 in the lamp holder 244.

FIGS. 17A, 17B and 17C show three different embodiments of lamp holders. As shown in FIG. 17A, lamp holder 252 has an inner wall 254 that protrudes outwardly from the lamp holder 252 beyond the outer wall 256 by a distance 258. The extended portion of the inner wall 254 engages the inner surface of the lens cover to provide an additional sealing surface on the interior portion of the neck of the lens cover.

As shown in FIG. 17B, lamp holder 260 has an outer wall 262 that protrudes beyond the inner wall 264 by a distance 266. The outer wall 262 engages the outer surface of the neck of the lens cover to provide an additional extended sealing surface 266 on the outer portion of the neck of the lens cover.

FIG. 17C illustrates another embodiment of a lamp holder 268. Lamp holder 268 has an outer wall 272 that extends the same distance as the inner wall 270. Both the inner wall 270 and the outer wall 272 engage and seal on the inner and outer surfaces, respectively, of the neck of the lens cover.

FIGS. 18A and 18B show the use of a waterproof o-ring seal 274 that is disposed in the ring cavity 134. As shown in FIG. 18B, the waterproof o-ring seal is placed at the end of the ring cavity 134 and fits tightly within the ring cavity 134. As shown in FIG. 18A, the lens cover 106 fits tightly down over the waterproof o-ring seal, and the end of the neck of the lens cover 106 forces the o-ring seal into the bottom of the ring cavity 134 to form a seal that tightly seals the lens cover 106 to the lampholder 102.

The present invention therefore provides a unique three-piece light emitting diode lamp that is watertight and allows the lens cover and light emitting diode to be easily replaced. The lamp holder 102 provides a waterproof housing that encapsulates the electrical components and connections so that moisture cannot penetrate the housing and corrode the various connections.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A watertight, light emitting diode lamp comprising:

a lens cover having an annular neck that forms a lens cover opening;

a light emitting diode having at least two light emitting diode leads, said leads having a crimp formed therein so as to create contact surfaces on said light emitting diode leads;

a lamp holder comprising:

at least two light emitting diode sockets that have conductive socket contact surfaces that are releasably engaged by said contact surfaces on said light emitting diode leads, so that said light emitting diode can be replaced;

at least two wire connectors that are conductively connected to said light emitting diode socket conductors and to at least two power leads;

a housing comprising a plastic insulating material that surrounds and encloses said light emitting diode sockets, said light emitting diode socket conductors and said wire connectors to seal said light emitting diode sockets, said light emitting diode socket conductors and said wire connectors from moisture and provide electrical isolation between said light emitting diode sockets, said light emitting diode socket conductors and said wire connectors, said plastic insulating material formed to provide an inner annular wall and an outer annular wall that create a ring cavity between said inner and outer annular walls having a size that substantially matches said annular neck of said lens cover to form a watertight seal between said lens cover and said lamp holder.

2. The light emitting diode lamp of claim 1 wherein said inner annular wall protrudes outwardly from said housing to form an extended portion of said inner annular wall that engages an inner surface of said annular neck along said extended portion of said inner annular wall and seals said inner surface of said annual neck along said extended portion of said inner annular wall.

3. The light emitting diode lamp of claim 1 wherein said outer annular wall protrudes outwardly from said housing to form an extended portion of said outer annular wall that engages an outer surface of said annular neck along said extended portion of said outer annular wall and seals said outer surface of said annular neck along said extended portion of said outer annular wall.

4. The light emitting diode lamp of claim 1 wherein said light emitting diode sockets have different lengths and said light emitting diode leads have different lengths that substantially match said different lengths of said light emitting diode sockets so that correct polarity is provided between said light emitting diode and said light emitting diode sockets.

5. The light emitting diode lamp of claim 1 wherein said light emitting diode sockets have different shaped openings and said light emitting diode leads have different shapes that substantially match said different shaped openings so that correct polarity is provided between said light emitting diode and said light emitting diode sockets.

6. The light emitting diode lamp of claim 1 further comprising:

a ring formed in said ring cavity that aligns with an annular indentation in said neck of said lens cover that holds and further seals said neck in said ring cavity.

7. The light emitting diode lamp of claim 1 further comprising:

a crossover device that is disposed in said housing between said at least two light emitting diode sockets;

crossover connector leads that are conductively connected to said crossover device and said at least two light emitting diode socket connectors.

8. The light emitting diode lamp of claim 1 further comprising:

a first power lead and a second power lead connected to a first wire connector of said plurality of wire connectors in said light emitting diode lamp;

a third power lead connected to a second wire connector of said plurality of wire connectors in said light emitting diode lamp so that said light emitting diode lamp can be connected in parallel with at least one additional light emitting diode lamp.

9. A method of manufacturing an light emitting diode lamp comprising:

molding an insulating plastic housing around at least two light emitting diode sockets that have conductive socket contact surfaces, at least two light emitting diode socket conductors that are conductively connected to said light emitting diode sockets and at least two wire connectors that are conductively connected to said light emitting diode socket connectors and to at least two power leads, to provide an insulated housing that seals said light emitting diode sockets, said light emitting diode socket conductors and said wire connectors from moisture and provides electrical isolation between said light emitting diode sockets, said light emitting diode socket conductors and said wire connectors;

forming an inner annular wall in said housing;

forming an outer annular wall in said housing that creates a ring cavity between said inner annular wall and said outer annular wall that has a pre-selected size;

providing an light emitting diode that has at least two light emitting diode leads;

forming a crimp in said light emitting diode leads that create contact surfaces on said light emitting diode leads;

inserting said light emitting diode leads into said light emitting diode sockets such that said contact surfaces of said light emitting diode leads slidingly and releasably engage said light emitting diode sockets to provide a conductive contact between said light emitting diode leads and said light emitting diode sockets while allowing said light emitting diode to be removed and replaced with another light emitting diode;

inserting a lens having an annular neck into said ring cavity such that at least one contact surface of said neck forms a watertight seal with said housing.

10. The method of claim 9 wherein said process of forming said inner annular ring further comprises forming an inner annular ring that protrudes from said housing.

11. The method of claim 9 wherein said process of forming said outer annular ring comprises forming an outer annular ring that protrudes from said housing.

* * * * *